United States Patent [19]

Juan

[11] Patent Number: 4,972,532

[45] Date of Patent: Nov. 27, 1990

[54] INFANT CARRIER

[76] Inventor: Reynaldo A. Juan, 29 Hetherington Pl., Brampton, Ontario, Canada, L6S 5M8

[21] Appl. No.: 441,657

[22] Filed: Nov. 27, 1989

[51] Int. Cl.[5] ..... A47D 7/00

[52] U.S. Cl. ..... 5/94; 5/430; 297/464

[58] Field of Search ..... 5/94, 424, 425, 430; 297/464; 224/158, 159; D6/333

[56] References Cited

U.S. PATENT DOCUMENTS 3,436,770 4/1969 Turner ..... 5/94
4,291,917 9/1981 Hawks ..... 297/460

FOREIGN PATENT DOCUMENTS 472841 10/1937 United Kingdom ..... 5/98 C
822749 10/1959 United Kingdom ..... 5/129

*Primary Examiner*—Alexander Grosz
*Attorney, Agent, or Firm*—Donald E. Hewson

[57] ABSTRACT

An infant carrier adapted to receive and retain an infant and to allow for efficient changing and cleaning of an infant is disclosed. Such changing and cleaning requires that the infant carrier provides unobstructed access to the anal and genital areas. Access thereto is gained through closable openings in the carrier in the anal and genital regions. The carrier keeps the infant in an ideal position and precludes the infant's legs from obstructing the changing or cleaning. Furthermore, the infant is not moved from the carrier for such cleaning or changing.

8 Claims, 2 Drawing Sheets

INFANT CARRIER

FIELD OF THE INVENTION

This invention relates to infant carriers, and more particularly to infant carriers that resemble a seat and are typically used to either change an infant's diaper, transport an infant, or allow an infant to sit upright or reclined while stationary.

BACKGROUND OF THE INVENTION

Infants, especially those under the age of 6 months, are unable or have difficulty in sitting unassisted, whether in an upright or reclined position. Alternatively, if they cannot sit by themselves, they can either be held or lie on a horizontal surface such as a blanket on a floor, or can be placed in a seat of some sort. Among the advantages of using a seat are comfort and allowing a child to look around. Such a seat would need to provide substantial support for an infant over most of the length of the body — ideally from the knees up. Additionally, some sort of means for precluding sideways movement of an infant is desirable.

It has been usual in the past to use small baskets or the like to transport and generally retain infants. Some of these baskets are arranged so as to prop up the infant when stationary, such that the infant is in an inclined seating position rather than lying down, and can therefore look around.

Modern types of infant seats and carriers are available that more closely resemble a seat and retain the infant in a shell usually having a bottom, a back and sides and also having some sort of leg apparatus for positioning the seat to a desired position or angle, or laying the seat back to a reclined position. Such a seat could therefore be used for having the infant sit and play, or for sleeping, or for generally carrying the infant around.

Typically, infant carrying seats are used to receive and retain an infant. However, the infant must be removed from the seat in order to change the infant's diaper or to just generally clean the infant in the lower torso region, or more specifically the anal and genital regions. Such necessity is often inconvenient just because of having to move the infant to a change table, change pad, or the like. More importantly, there is not always a place available to change an infant if the infant is not at home. It would be much more convenient if an infant could be changed without being moved from the infant seat.

Another problem that is encountered is that an infant is often too young to hold its legs up so as to allow relatively unobstructed access to the anal and genital areas for cleaning. Even with using change tables, or other horizontal surfaces, there is no means for keeping the infant's legs from obstucting the anal and genital areas. Thus, it is necessary for the person changing the diaper or cleaning the infant to keep the legs up with one hand while cleaning or diapering with the other hand. Furthermore, infants typically tend to roll to one side or another or from side to side while being changed or cleaned, which makes the whole process much more difficult. Additionally, if a raised change table is being used then there is the possibility that the infant may indeed roll off the side of the change table.

DESCRIPTION OF THE PRIOR ART

It has been common to use as an infant carrier a moulded plastic seat having a back portion that supports an infant from the buttocks to the head, a bottom portion that supports the buttocks and upper legs, and sides that keep the infant from rolling side to side in the carrier and also from rolling out of the carrier. Such a carrier often has a set of legs or some sort of frame that serves the purpose of supporting the carrier in either an upright or inclined position. Such carriers very nicely serve the purpose of retaining, and even restraining the infant, but make it very difficult to access the infant for changing, cleaning, and so on, particularly for changing diapers.

Other such carriers are more basket like, having a back portion, a side portion, and sides, but are structured to enclose the infant more completely, thus making it even more difficult to access the infant for changing, or whatever. It is believed that such carriers evolved, at least indirectly, from simple basket type carriers, such as wicker baskets, that have been known for a good number of years. Indeed, the basic structure and functionality of such carriers have not changed from such early simple baskets.

Other related prior art includes change tables, which are typically tables that have a flat padded surface at the top and are usually of a size such that the infant has more than sufficient room to move around. Also included ar raised sides to preclude the infant from falling off. Such a table is not ideal for changing or cleaning an infant since the infant has so much room to roll around. Changing of a diaper and cleaning of the anal and genital areas of an infant require the infant to be relatively still and lying generally face up. Such change tables typically have only simple strap means for keeping the infant as such, which is both uncomfortable and not overly effective. Furthermore, an infant's legs would still be completely unrestrained and therefore would often obstruct the anal and genital areas during cleaning and changing.

SUMMARY OF THE INVENTION

It is the basic object of the present invention to provide means that can be used as a seat or carrier for an infant and also can be used to retain an infant when being cleaned or changed. Most often, when an infant is changed it is the diaper that needs to be changed. The clothing is either removed or pertially removed. The diaper is then removed, and the anal and genital areas of the infant are cleaned and possibly some lotion or cream put on, and then another diaper is replaced on the infant. Any clothing can then be replaced. Obviously it is necessary to have relatively unencumbered access to a substantial portion of the anal and genital areas for both removing and replacing clothes and diapers, and for cleaning and for bathing therearound.

It is also desirable when changing an infant to have the infant remain relatively still, and to have the infant's legs placed upwardly to some degree, so as to provide unobstructed access to the anal and genital regions of the infant.

The present invention provides an infant's carrier that is adapted to be used as a change seat by providing direct and unobtructed access to the anal and genital areas for changing. Such access is realized through the inclusion of certain integers, preferably of an operable nature, that provide openings in the appropriate areas of the carrier. Somewhat unexpectedly, it has been found that an infant carrier configured as described allows for an infant to easily have a diaper changed without removal from the carrier. It has been also found that changing an infant's diaper in the carrier is more efficient and causes less duress than using conventional methods since the infant is comfortably retained in a suitable position.

The carrier can be also used for bathing or generally cleaning, for checking for diaper rashes, and so on, as easily as it can be used for changing diapers.

The carrier can of course be used as an ordinary seat for the infant sitting, playing or generally being moved around.

BRIEF DESCRIPTION OF THE DRAWINGS

Embodiments of this invention will now be described by way of example in association with the accompanying drawings, in which.

DETAILED DESCRIPTION OF THE PREFERRED EMBODIMENTS

Figure 1:
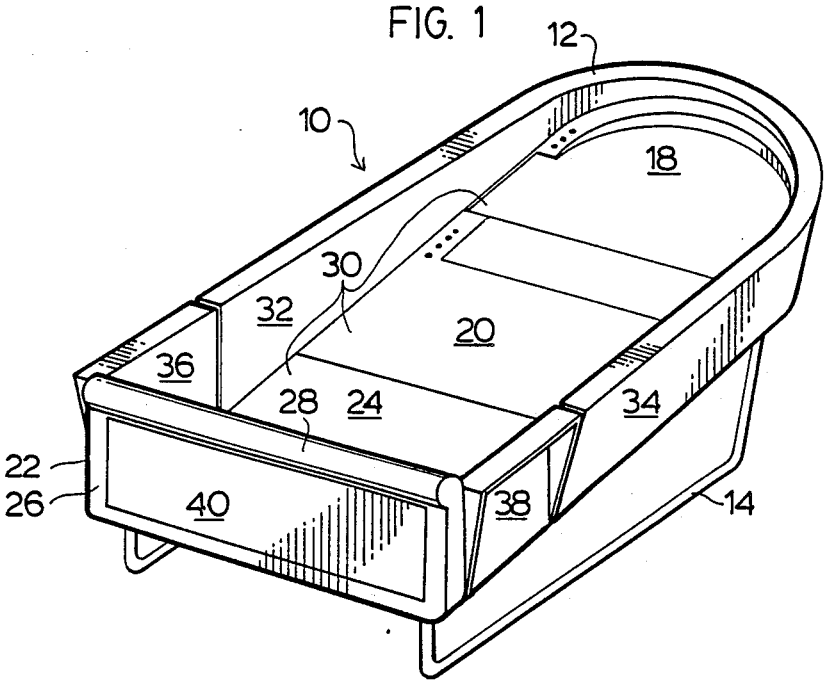
FIG. 1 shows a perspective view of the infant's seat configured for carrying an infant.

Reference is now made to FIG. 1 in which an infant carrier 10 is shown, having a shell support 12 and a positioning means 14 adjustably attached thereto. Preferably, the attachment points of the positioning means 14 to chair support 12 are changeable in order to allow the chair support to be inclined at different angles, from substantially horizontal to fairly upright.

Shell support 12 comprises a head receiving portion 18 in the upper area, a trunk receiving portion 20 in the middle area and a buttock receiving portion 22 in the lower area. Buttock receiving portion 22 in turn comprises a rear planar portion 24 and an end planar portion 26, both portions being rigidly attached to one another and generally displaced perpendicularly from one another with a rounded corner therebetween.

Buttock receiving portion 22 is adapted to receive an infant with the thigh portion of the infant's legs being generally perpendicular to the rear planar portion 24 of buttocks receiving portion 22. Leg support means 28 is relatively displaced from rear planar portion 24 by end planar portion 26, such that leg support means 28 would locate itself generally under the knee area of an infant, thus keeping the infant's upper legs substantially perpendicular to the rear planar portion 24, and removed from the vicinity of the anal and genital areas, thus allowing for easy access thereto for cleaning, diapering etc.

The head receiving portion 18, the trunk receiving portion 20, and the rear planar portion 24 of buttock receiving portion 22 are all part of the posterior support 30 of the infant carrier 10. Posterior support 30 supports the entire back side of the infant.

In order to keep the infant from rolling or moving sideways within the infant carrier 10, and of course from falling out of it, it is necessary to have a first side 32 and a second side 34, one on each side of the posterior support 30. In the preferred embodiment the first side 32 and the second side 34 are higher in the area of the buttock receiving portion 22 than in the area of the head receiving portion 18. This precludes the legs, or at least the thigh portion of the legs, from swinging over the top of the first or second sides 32, 34. Additionally, the side suppports 32, 34 help keep anything such as soothers, toys, or remnants of food, and so on, in the infant carrier 10.

In order to access an infant's anal and genital areas while in the seat, first side access means 36 and second side access means 38 have been included in first and second sides 32, 34 respectively, and buttock access means 40 has been included in the planar portion 26 of buttock receiving portion 22. It is necessary that these integers, first side access means 36, second side access means 38 and buttock access means 40 be included in the infant carrier 10. Additionally, each of these integers must be adapted to allow unobstructed access to the anal and genital areas by opening from a closed position to an open position. Such integers are not found on other types of infant carriers.

In the preferred embodiment, first side access means 36 and second side access means 38 are operable such that when it is necessary to gain access to the anal or genital areas of an infant the first and second side access means 36, 38 can be moved from their position as part of the first side 32 and the second side 34 respectively. The infant's anal and genital areas are now accessible for removing and replacing clothing and diapers, or for cleaning, bathing, or inspecting the infant. Once the infant is finished being changed or cleaned, the first and second side access means can be replaced.

The end planar portion 26 in buttock receiving portion 22 has a buttock access means 40 therein, that is operable in a manner similar to first and second side access means 36, 38 in that it can be moved from the vicinity of end planar portion 26 when it is desirable to gain access to the infant's anal and genital areas. Buttock access means 40 extends from side to side across most of end planar portion 26 and extends from the vicinity of the leg support means 28 to the area of transition between end planar portion 26 and rear planar portion 24. It is also possible for buttock access means 40 to extend beyond the rounded corner joining end planar portion 26 and rear planar portion 24 and to therefore include a portion of rear planar portion 24.

In the preferred embodiment, the first and second side access means 36,38 and buttock access means 40 are pivotally attached to the posterior support 30. If the shell support 12 and the various operable integers are to be made from polyethelene plastic, then preferably living hinges are used to connect the operable integers to the shell support 12. Alternatively, a piano type hinge could just as easily be used, and indeed almost any type of hinge means may be used quite readily.

When the infant seat is being used to transport an infant, it is preferable to keep the first side access means 36, second side access means 38 and buttock access means 40 in their closed positions. It is also preferable to keep these integers latched in their closed positions such that they are precluded from opening unwantedly. Contemplated latching means include a system having one or more projecting arms and one or more corresponding and co-operating holes for receiving and retaining said projecting arms. Also, a co-operating hook and anchor fastening system is contemplated. Obviously, many types of latching means can be used successfully.

When the first side access means 36, second side access means 38 and buttock access means 40 are closed and latched in place, the infant carrier 10 acts as a regular infant carrier to be used to seat, transport, or generally carry a baby.

In use, first side access means 36, second side access means 38 and buttock access means 40 operate independently and any one can be used without using the other. It is typical, however, that all three be used in conjunction with one another, especially when cleaning an infant.

Figure 2:
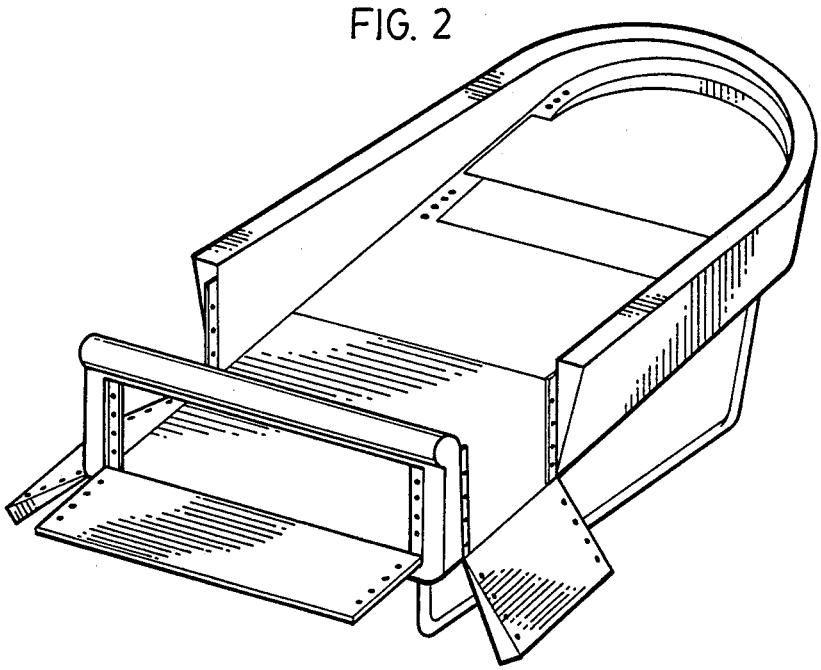
FIG. 2 shows the same infant's seat as FIG. 1 configured to allow access to the anal and genital regions of an infant for changing.

Reference will now be made to FIG. 2 which shows the infant carrier with the first side access means 36 the second side access means 38 and the buttock access means 40 all in an open position, to allow access to an infant's anal and genital areas. As can be seen, it would be quite convenient to reach both the infant's diaper for removal and replacement thereof, and also the infant's anal and genital areas for cleaning, bathing, and so on.

Figure 3:
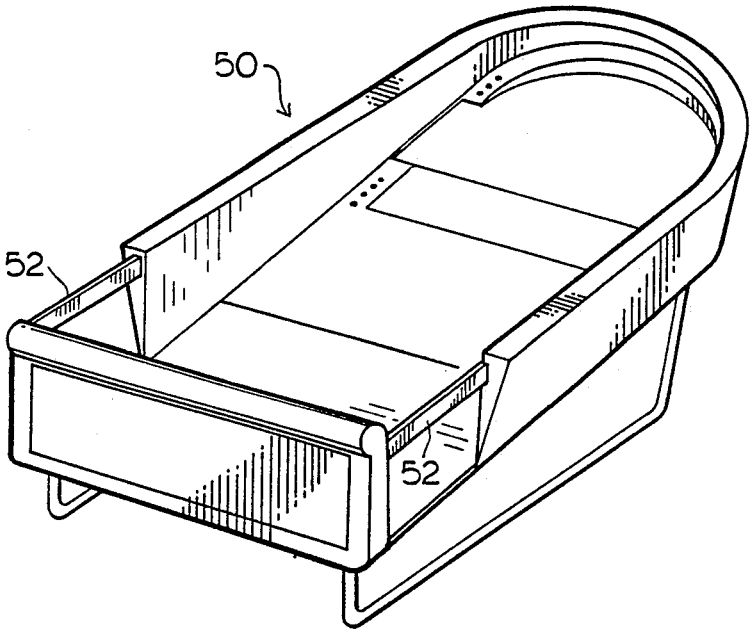
FIG. 3 shows an alternative embodiment to the infant's seat of FIG. 1 and FIG. 2.

Reference will now be made to FIG. 3 in which an infant carrier 50, similar to the one shown in the preferred embodiment, is contemplated. In place of operable side access means however, there are open areas in the first and second sides, with a restricting means 52, such as a bar or a strap, thereacross to preclude an infant from falling out.

Figure 4:
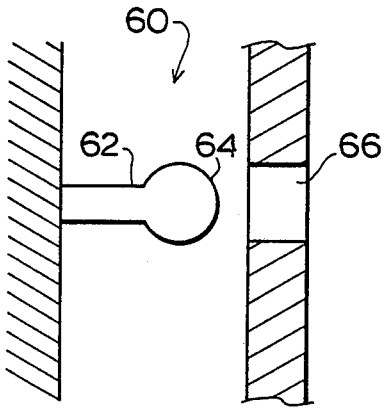
FIG. 4 shows a close up view of the latching means used.

Reference will now be made to FIG. 4 in which the latching means 60 is shown to comprise a projecting arm 62 having an enlarged portion 64. The projecting arm 62 is adapted for entry into co-operating hole 66. Enlarged portion 64 is very slightly larger than co-operating hole 66, thereby precluding easy removal of the projecting arm 62 from co-operating hole 66.

Other modifications and alterations may be used in the design and manufacture of the infant carrier of the present invention without departing from the spirit and scope of the accompanying claims.

What is claimed is:

1. An infant carrier adapted to permit access to an infant's anal and genital areas while in the carrier, comprising:

a trunk receiving portion adapted to receive and retain the trunk area of an infant;

a head receiving portion adapted to receive and retain the head of an infant;

a first side and a second side connected to said trunk receiving portion and said head receiving portion, one on each side thereof, for precluding an infant from moving sideways out of said infant carrier;

a buttock receiving portion adapted to receive and retain the extreme lower back area, the buttock area, and the upper rear thigh area of an infant, comprising a generally horizontal rear planar portion and a generally vertical end planar portion, and leg support means for supporting the back side of the thighs in the knee area, and buttock access means comprising an outwardly pivotal panel for receiving and retaining said lower buttock area and upper rear thigh area of an infant when in a closed position and for allowing access to the genital and anal areas of an infant when in an open position, and latching means for retaining said buttock access means in said closed position;

said head receiving portion, said trunk receiving portion, and said rear planar portion of said buttock receiving portion being connected one to another to form a posterior support portion; and first side access means and second side access means, one on each side of said buttock receiving portion, for allowing access to the anal and genital areas of an infant.

2. The infant carrier of claim 1, wherein said first and second side access means each are an extension of said first and second sides respectively and are operable between an open position and a closed position, and are for precluding an infant from moving sideways out of said infant carrier when in a closed position and for allowing direct access to the anal and genital areas of an infant when in an open position, and latching means for retaining said first and second side access means in said closed position.

3. The infant carrier of claim 2, wherein said first and second side access means each are pivotally operable.

4. The infant carrier of claim 2, wherein said latching means comprises at least one projecting arm and at least one corresponding and co-operating hole for receiving and retaining said projecting arm.

5. The infant carrier of claim 1, wherein said head receiving portion is generally of a concave shape to more comfortably accommodate an infant's head.

6. The infant carrier of claim 1, wherein said latching means comprises a co-operating hook and anchor fastening system.

7. The infant carrier of claim 1, wherein said first side support and said second side support each comprise an opening and with a restricting means placed across said opening to preclude an infant from falling out.

8. The infant carrier of claim 1, wherein said first side support and said second side support are connected at the top area of said head receiving portion.

* * * * *